US011359316B2

(12) United States Patent
Gupta et al.

(10) Patent No.: US 11,359,316 B2
(45) Date of Patent: Jun. 14, 2022

(54) DISPENSER FOR THREAD TREATMENT COMPOUND

(71) Applicant: DPG USA, Inc., Schaumburg, IL (US)

(72) Inventors: Nikhil Gupta, Schaumburg, IL (US); Ronald C. Farnum, Lombard, IL (US); John C. Olson, Livingston, TX (US)

(73) Assignee: DPG USA INC., Schaumburg, IL (US)

( * ) Notice: Subject to any disclaimer, the term of this patent is extended or adjusted under 35 U.S.C. 154(b) by 0 days.

(21) Appl. No.: 15/963,024

(22) Filed: Apr. 25, 2018

(65) Prior Publication Data

US 2018/0237969 A1 Aug. 23, 2018

Related U.S. Application Data

(63) Continuation of application No. 14/983,642, filed on Dec. 30, 2015, now Pat. No. 9,982,377.

(60) Provisional application No. 62/117,130, filed on Feb. 17, 2015, provisional application No. 62/098,265, filed on Dec. 30, 2014.

(51) Int. Cl.
*D05B 67/00* (2006.01)

(52) U.S. Cl.
CPC ..... *D05B 67/00* (2013.01)

(58) Field of Classification Search
CPC ..... B65H 71/005; Y10S 118/22; D05B 37/00; D05B 67/00; A01K 97/00; D05C 11/24; D03J 1/04; B05C 3/125; D01H 13/308
See application file for complete search history.

(56) References Cited

U.S. PATENT DOCUMENTS

| | | | | | |
|---|---|---|---|---|---|
| 839,567 | A * | 12/1906 | Emerson | B65H 71/005 | 118/78 |
| 1,856,882 | A * | 5/1932 | Myers | D05B 67/00 | 112/256 |
| 2,344,883 | A * | 3/1944 | Kairalla | A45D 40/02 | 401/11 |
| 2,477,422 | A * | 7/1949 | Roseman | D05B 59/00 | 118/78 |
| 2,897,774 | A * | 8/1959 | Alexander | B65H 71/007 | 112/256 |
| 3,479,988 | A * | 11/1969 | Trost | B65H 71/005 | 118/78 |
| 4,501,222 | A * | 2/1985 | Stone | B05C 17/00 | 118/234 |
| 6,029,387 | A * | 2/2000 | Swor | A01K 97/00 | 30/278 |
| 2003/0007825 | A1* | 1/2003 | De Laforcade | A45D 19/02 | 401/10 |

* cited by examiner

*Primary Examiner* — David P Angwin
*Assistant Examiner* — Bradley S Oliver
(74) *Attorney, Agent, or Firm* — Michael W. Ferrell; Robert S. Alexander; Anna L. Kinney

(57) ABSTRACT

A thread conditioner dispenser is provided as well as a method of conditioning thread. The dispenser has a base with two longitudinally extending sidewalls attached which are joined by two transverse sidewalls. A receptacle for thread conditioning compound is defined interior thereto. Notches are formed in each transverse sidewall. The point on each notch closest to the base defines a saddle point. An adhesive layer is attached to the base such that the dispenser may be removably attached to a solid surface. Thread may be passed through one of the notches and withdrawn through the opposed notch.

14 Claims, 15 Drawing Sheets

Fig. 23
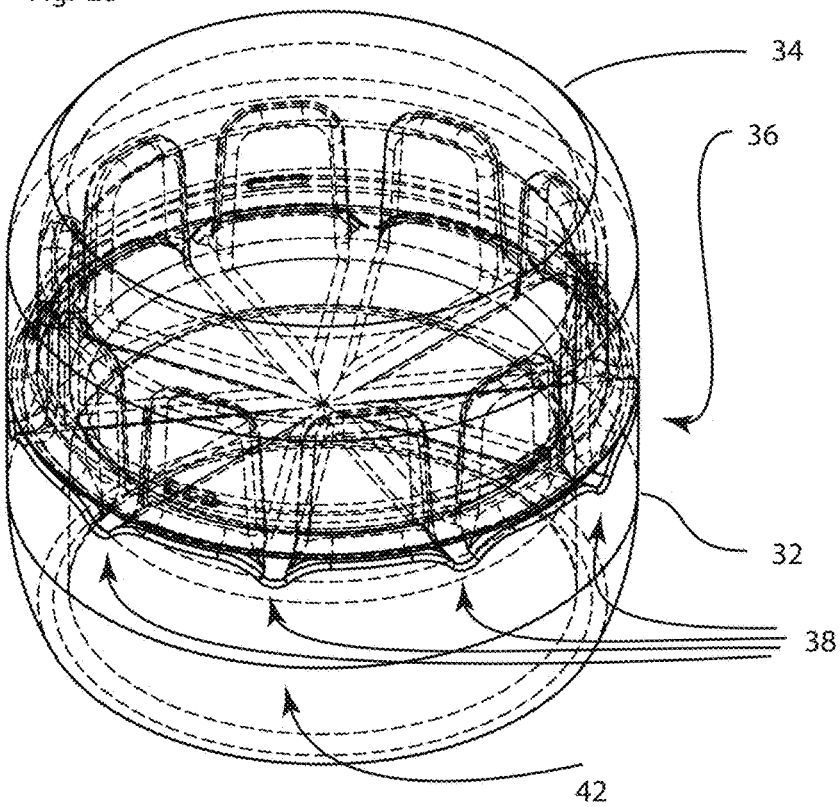
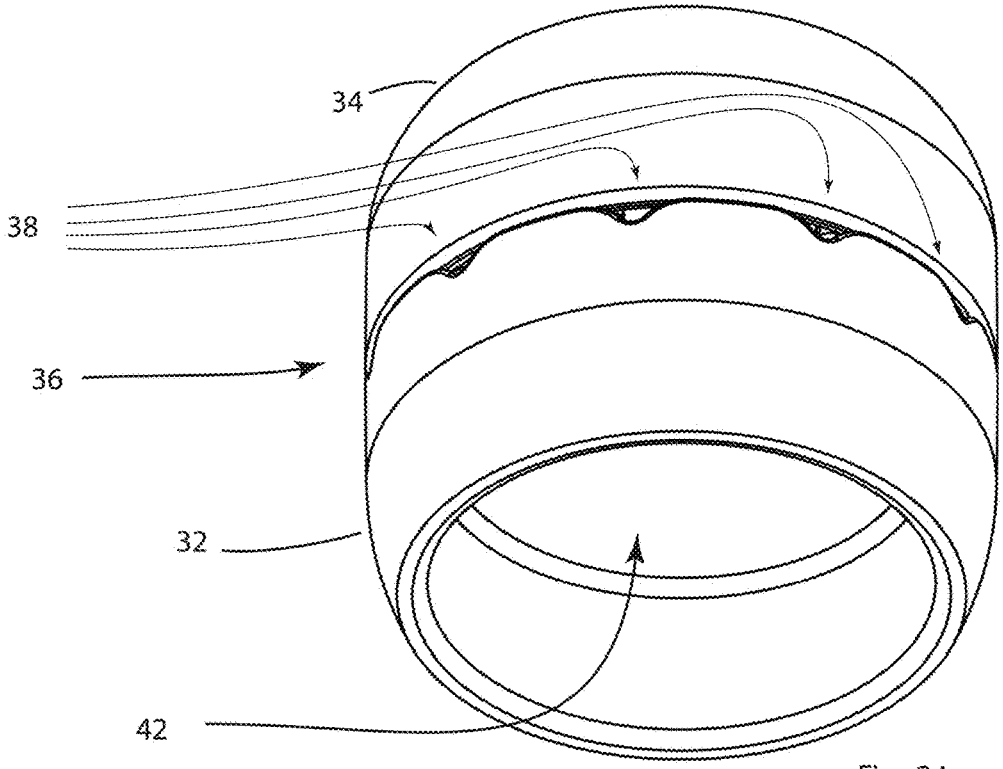
Fig. 24

Fig. 36
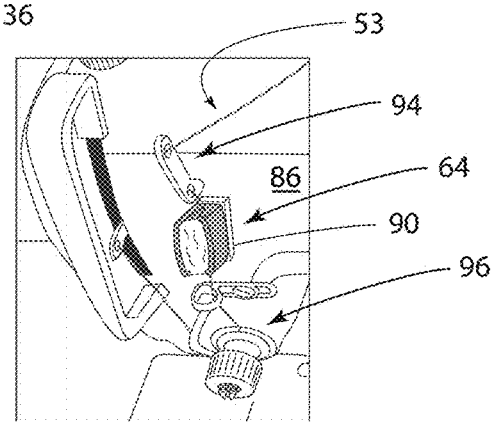
Fig. 37
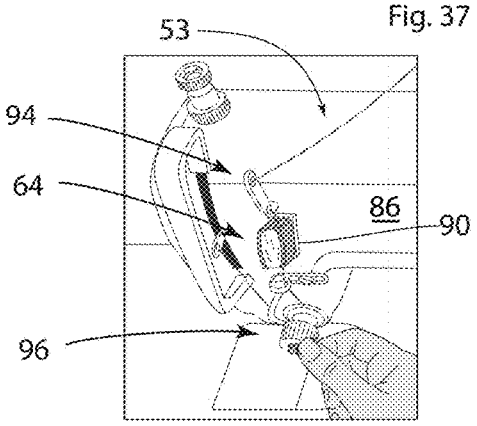
Fig. 38
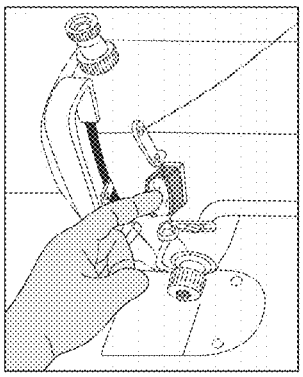
Fig. 39
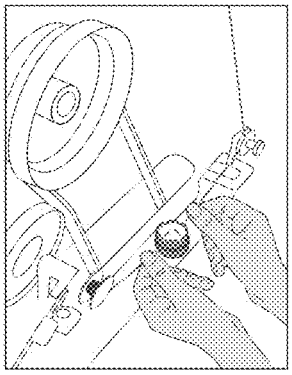
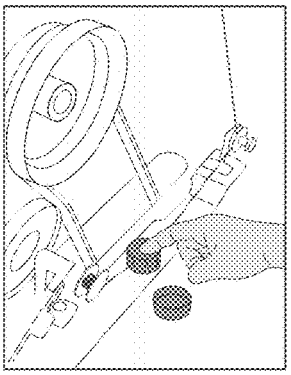
Fig. 40
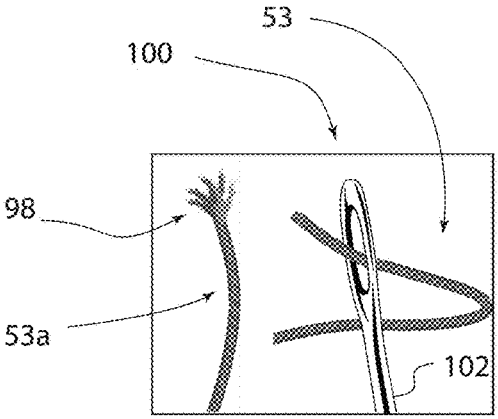
Fig. 41

DISPENSER FOR THREAD TREATMENT COMPOUND

CLAIM FOR PRIORITY

This application is a continuation of U.S. application Ser. No. 14/983,642, filed Dec. 30, 2015, of the same title, now U.S. Pat. No. 9,982,377. U.S. application Ser. No. 14/983,642 was based on U.S. Provisional Patent Application Ser. No. 62/098,265, filed on Dec. 30, 2014, and U.S. Provisional Patent Application Ser. No. 62/117,130, filed on Feb. 17, 2015, both entitled "Dispenser for Thread Treatment Compound". The Priorities of application Ser. Nos. 14/983,642, 62/098,265, and 62/117,130 are hereby claimed and their disclosures are incorporated by reference in their entireties.

BACKGROUND OF THE INVENTION

Thread can be quite troublesome even though it is extremely useful in many applications particularly in formation of clothing, quilting, manufacture of books, and beading. It can kink and curl resulting in knots and tangles, be difficult to pass through the eye of a needle and acquire a static charge making it difficult to control. Various compounds are known for pretreating thread prior to use to help alleviate or ameliorate some of these difficulties. Such compounds include beeswax, petroleum derived paraffins, a wide variety of silicone compounds, lubricants and stiffening agents. However, for hobbyists who wish to treat small amounts of thread immediately prior to use, a need exists for a convenient, easily portable, and inexpensive dispenser which will assure contact between the thread and the pretreatment compound. Further, those who sew to produce items for a living often find their efficiency and productivity reduced by issues relating to problematic behavior of thread as thread has a tendency to fray, kink and tangle due to static electricity as well as to stray out of the eye of the vertical needle of sewing machines.

SUMMARY OF THE INVENTION

The thread conditioning dispenser of the present invention used for hand sewing comprises a generally cylindrical retention and dispensing portion having a recess formed in the bottom thereof, and a cup thereabove having a generally cylindrical upstanding sidewall thereabout defining a retention cavity, said generally cylindrical upstanding resilient sidewall having a plurality of notches formed therein and a mating cap portion having a generally cylindrical sidewall with an outwardly flaring or tapered mouth and a circumferential recessed ring formed into one of the interior wall of said generally cylindrical sidewall of said cap and said generally cylindrical upstanding resilient sidewall of said retention and dispensing portion with a mating lug being formed into the other of said generally cylindrical sidewall of said cap and said generally cylindrical upstanding resilient sidewall of said retention and dispensing portion being adapted to retain said cap on said retention and dispensing portion, said cap being adapted to mate with the generally cylindrical upstanding resilient sidewall and partially seal said retention cavity while leaving the portion of said notches closest to said recessed bottom exposed, said cap, notches and resilient sidewall being configured such that thread may be passed through one of said notches into said retention cavity and out of another of said notches with said cap in engagement with said resilient sidewall. Preferably when the cap engages said resilient sidewall, portions thereof between said notches are urged inwardly forcing said lug into engagement with said circumferential recessed ring. Preferably the notches will have a wider opening at the top of said generally cylindrical upstanding resilient sidewall and will narrow as they approach the bottom of said retention and dispensing portion. More preferably the lower extremities of the legs of said notches will be joined by a radiused bottom portion; and thus said notches will either be U-shaped or V-shaped with V-shaped notches being more preferred. Desirably, the lower extremity of the notch will form at least a local maximum, but preferably a saddle point wherein the radius of curvature of the generators of the surface as viewed normal to the side wall are curved upwardly but are curved downwardly when viewed in the direction lying within the surfaces of the sidewall and transverse to the opening of the notch through the sidewall.

The thread conditioning dispenser of the present invention used for machine sewing comprises a retention receptacle having a bottom and upstanding side walls with two notches formed therein at opposed portions of the sidewalls with the notches extending to within no more than about three millimeters of the bottom of said receptacle. Preferably the distance between the bottom of each said notch and the bottom of said receptacle portion will be less than about 2 millimeters; and, more preferably, will be less than one millimeter. The exterior surface of the bottom of said receptacle will bear an attachment device such as double stick tape, hook and loop fabric (one version of which is sold under the Trademark Velcro), or a mating flexible resilient upright and cavity fixture so that the receptacle may be removably attached to the arm of the sewing machine between the reciprocating take up lever and the upper tension regulator. To that end, the attachment device or fixture will be generally no more than 6 millimeters, preferably no more than 4 millimeters, more preferably no more than 3 millimeters, still more preferably no more than 2 millimeters and most preferably no more than 1 millimeter in thickness.

Another aspect of this invention relates to a method of manually conditioning thread, comprising the steps of: providing a thread; providing a thread conditioning dispenser retaining a mass of thread conditioner, said thread conditioning dispenser having a cavity for retention of said mass of thread conditioner, said cavity having a base and side walls, at least one notch and another notch being formed in said sidewalls with a linear channel optionally being formed into said base connecting said one notch and said other notch notches in said sidewalls; and urging said thread into said mass of conditioner by disposing said thread adjacent said dispenser with a portion adjacent said one notch, another portion adjacent said other notch and exerting tension upon said thread urging it into said notches and into said mass of conditioner.

Yet another aspect of this invention relates to a method of conditioning thread to be placed upon a bobbin in a sewing machine, comprising the steps of: providing a bobbin, a supply spool having thread wrapped there around, a sewing machine having a thread supply spindle, guide means for directing thread wrapped round/spool to said bobbin, and means for rotating said bobbin; providing a thread conditioning dispenser retaining a mass of thread conditioner, said thread conditioning dispenser having a cavity for retention of said mass of thread conditioner, said cavity having a base and side walls, at least one notch and another notch being formed in said sidewalls with a linear channel optionally being formed into said base connecting said one notch and said other notch or notches in said sidewalls; obtaining a free end of a length of thread from said supply spool, passing it through said guide means and securing it to said bobbin; urging said thread into said mass of conditioner by disposing said thread adjacent said dispenser with a portion adjacent said one notch, another portion adjacent said other notch and exerting tension upon said thread urging it into said notches and into said mass of conditioner; and drawing said thread through said mass of conditioner while applying pressure to said mass of conditioner to ameliorate tunneling occasioned by passage of said thread through said mass of conditioner.

BRIEF DESCRIPTION OF THE DRAWINGS

The invention is described in detail below with reference to the appended drawings, wherein like numerals designate similar parts. In the Figures:

FIG. 23 is a skeletonized perspective of the thread conditioning dispenser of FIG. 19;

FIG. 24 is an exterior lower perspective view of the thread conditioning dispenser of FIG. 19;

FIGS. 36-38 schematically illustrate use of the thread conditioning dispenser of the present invention to treat thread as it is being advanced to the upper needle of a conventional home sewing machine from an exterior supply spool;

FIGS. 39 and 40 schematically illustrate an alternative method of applying conditioner from the thread conditioning dispenser of the present invention to treat thread as it is being wound onto the bobbin of a conventional home sewing machine;

FIG. 41 illustrates both a frayed end of a thread and passage of an unfrayed (treated) thread through the eye of a needle.

DETAILED DESCRIPTION OF THE PREFERRED EMBODIMENTS

Figure 1:
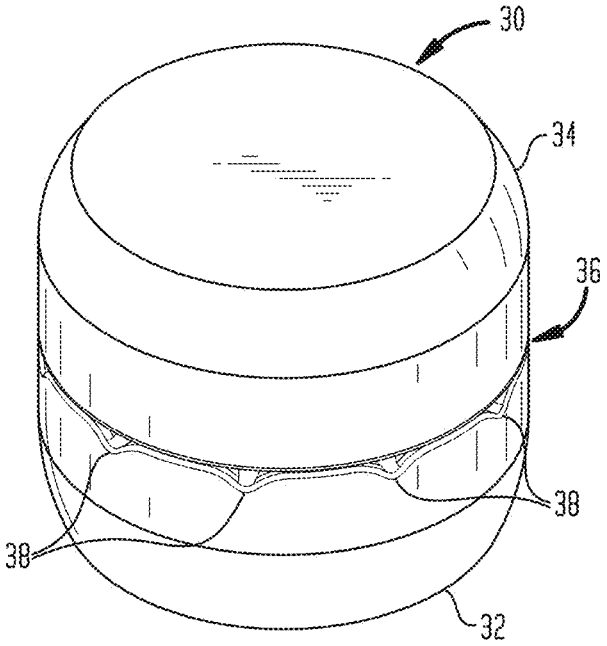
FIG. 1 is an isometric perspective of a thread conditioning dispenser of the present invention with the mating cap in position sealing the retention cavity.
Figure 2:
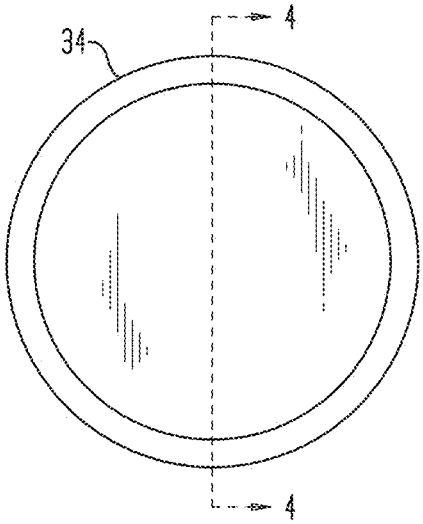
FIG. 2 is a top view of the thread conditioning dispenser of FIG. 1.
Figure 3:
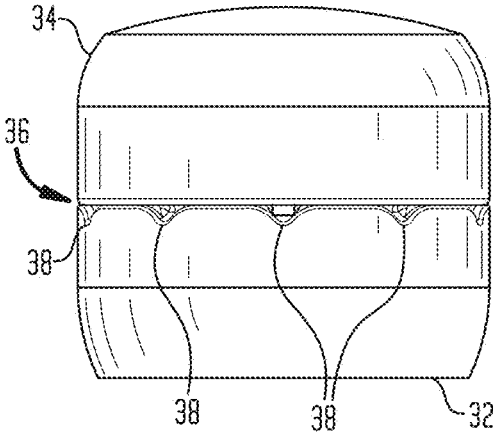
FIG. 3 is a front elevation of the thread conditioning dispenser of FIGS. 1 and 2.
Figure 4:
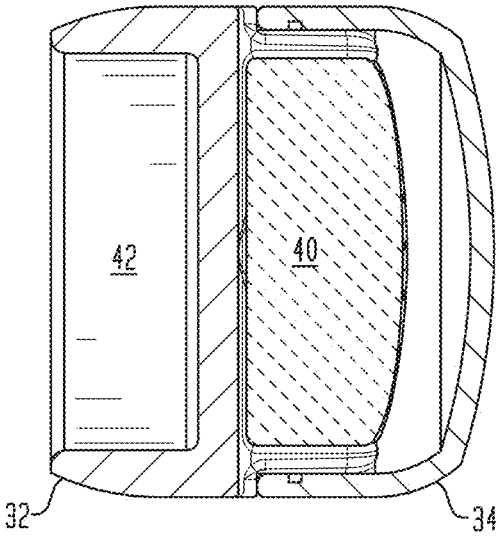
FIG. 4 is a sectional schematic of the thread conditioning dispenser of FIGS. 1-3 taken along section line 4-4 of FIG. 2.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

In FIGS. 1-4, thread conditioning dispenser 30 comprises conditioner storage and dispensing portion 32 and cap portion 34 matingly engageable therewith. Along juncture 36 between conditioner storage and dispensing portion 32 and cap portion 34, a plurality of thread passage openings 38 are formed such that thread passing therethrough will contact thread conditioner 40 retained in conditioner storage and dispensing portion 32. Recess 42 is formed in the bottom of condenser storage and dispensing portion 32 to facilitate handling and positioning of thread conditioning dispenser 30, particularly with respect to easily holding dispenser 30 while manually coating thread. In particular, a user may wish to place recess 42 over either a thumb or finger and press upon dome 33 with any other convenient digit, thus being able to easily hold thread conditioning dispenser 30 with one hand leaving the other free to draw thread 53 through mass of conditioner 40.

Figure 5:
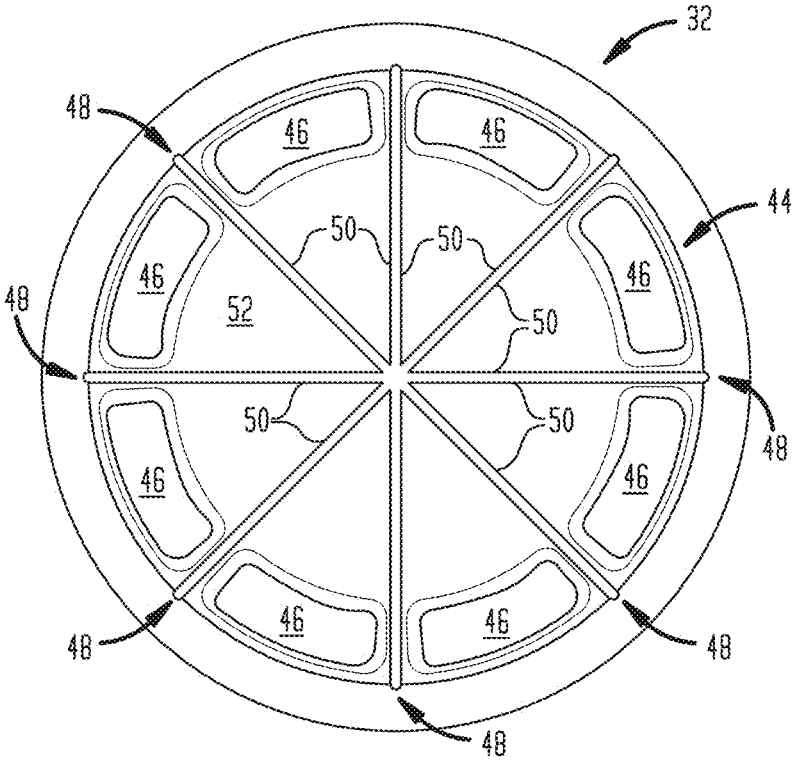
FIG. 5 is a plan view of the container portion of the thread conditioning dispenser of the present invention.
Figure 6:
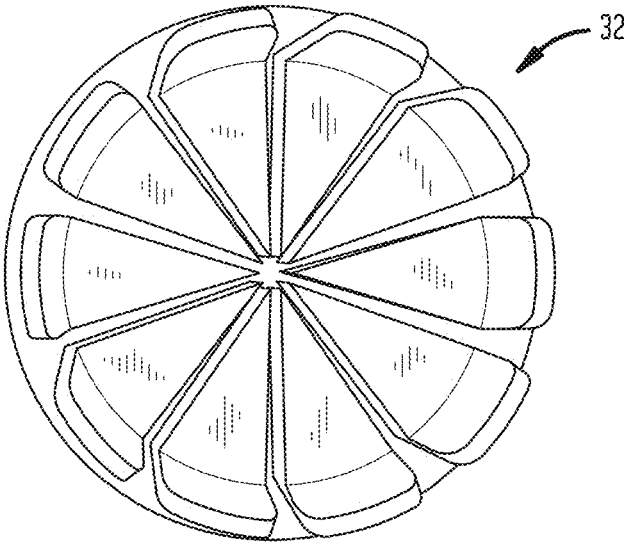
FIG. 6 is a perspective view of a thread conditioning dispenser of the present invention corresponding to FIG. 5.
Figure 7:
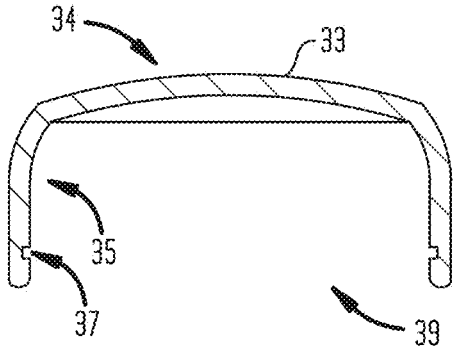
FIG. 7 is a sectional view of the cap of the thread conditioning dispenser of the present invention taken along line 4-4 of FIG. 2.
Figure 8:
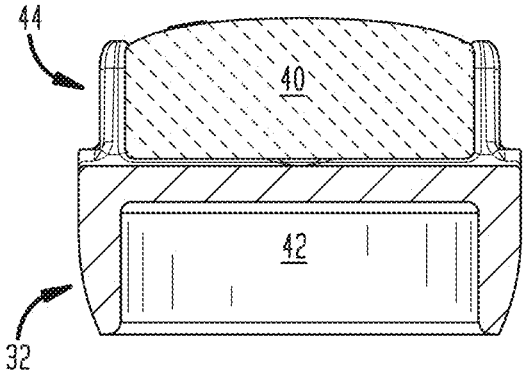
FIG. 8 is a sectional view of the container and dispensing portion of the thread conditioning dispenser of the present invention taken along line 4-4 of FIG. 2.
Figure 9:
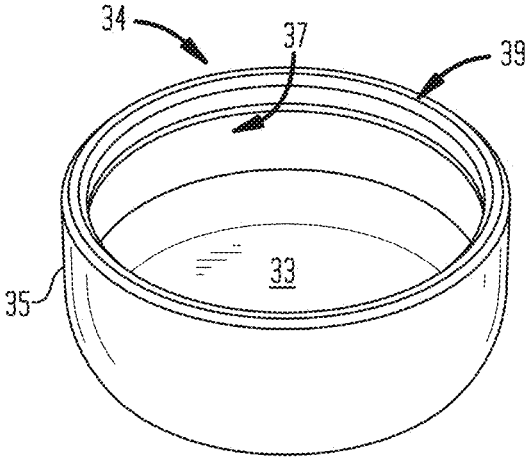
FIG. 9 is an isometric perspective of the cap of FIG. 7 in an inverted posture.
Figure 10:
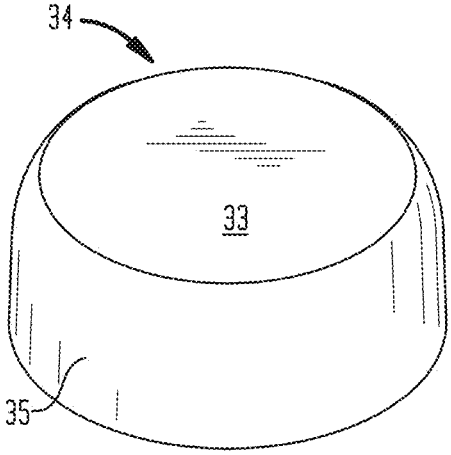
FIG. 10 is an isometric perspective of the cap of FIG. 7.
Figure 11:
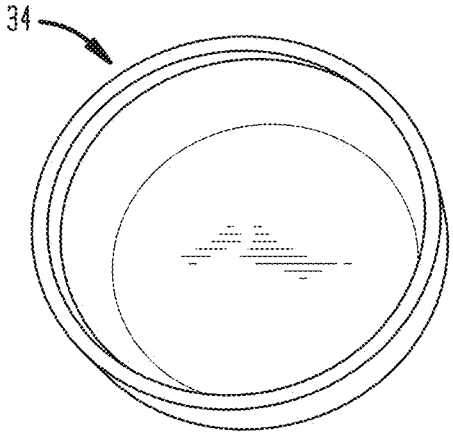
FIG. 11 is a perspective view of the cap of FIG. 9.
Figure 12:
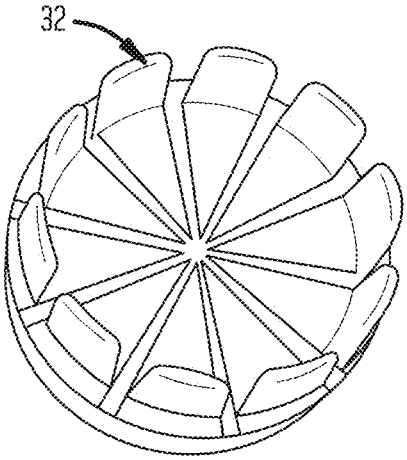
FIG. 12 is a perspective view of the container and dispensing portion of the thread conditioning dispenser to the present invention (without conditioner therein)
Figure 14:
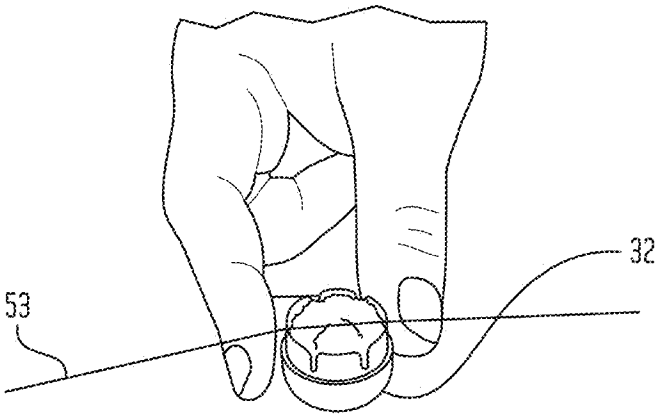
FIGS. 13-18 schematically illustrate use of the thread conditioning dispenser of the present invention to treat thread as it is being wound onto the bobbin of a conventional home sewing machine with FIGS. 14, 16 and 18 being detail views of FIGS. 13, 15 and 17 respectively.
Figure 13:
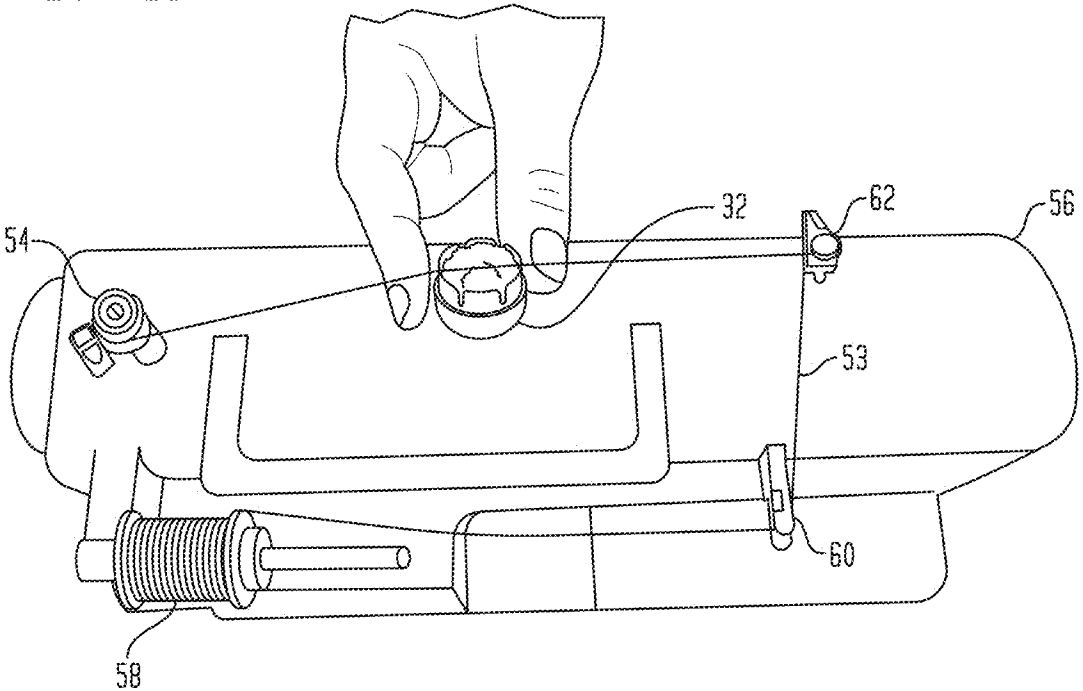
Figure 15:
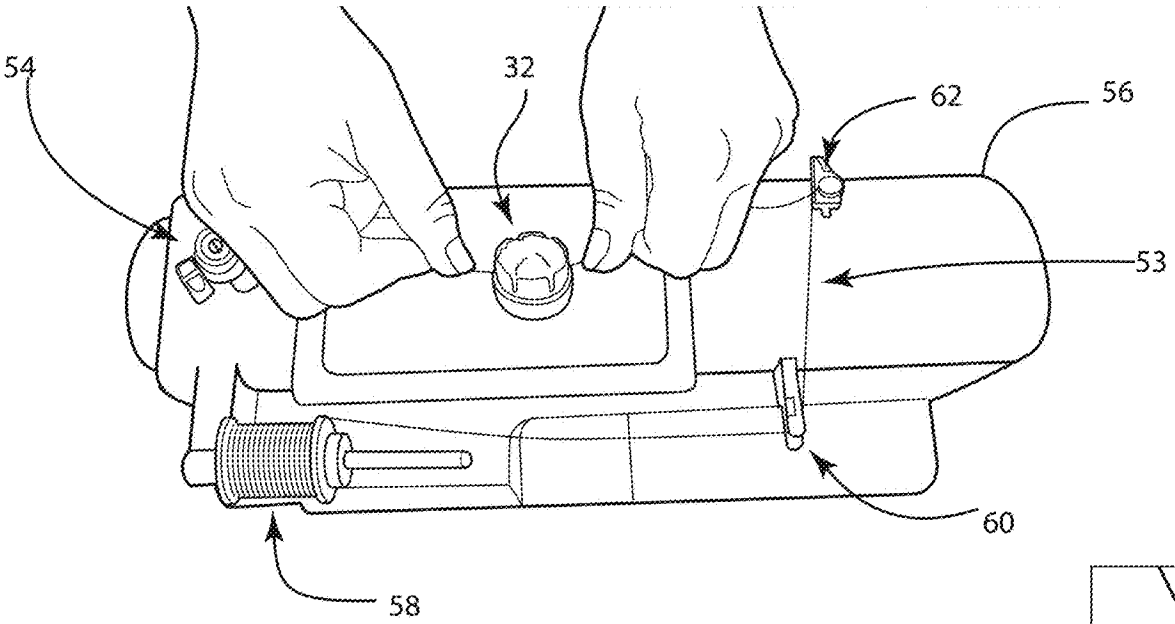
Figure 16:
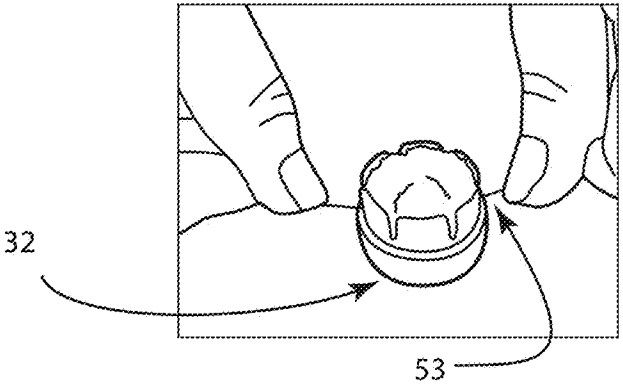
Figure 17:
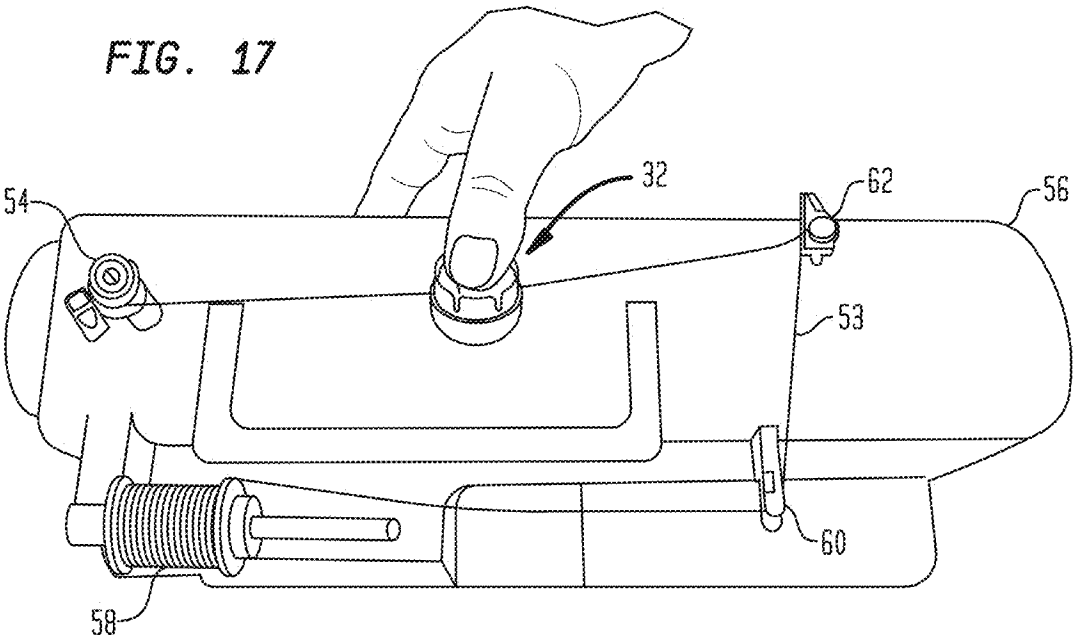

In FIGS. 5 and 6 conditioner storage and dispensing portion 32 is defined by generally cylindrical upstanding resilient sidewall 44 comprising a plurality of upstanding resilient plinths 46 having notches 48 therebetween. Notches 48 narrow downwardly to channels 50 defined in base 52 of conditioner storage and dispensing portion 42. Channels 50 linearly extend through base 52 of conditioner storage and dispensing portion 32 such that thread entering through any one of notches 48 may be withdrawn through a diametrically opposed notch 48 formed between upstanding resilient plinths 46.

Figure 20:
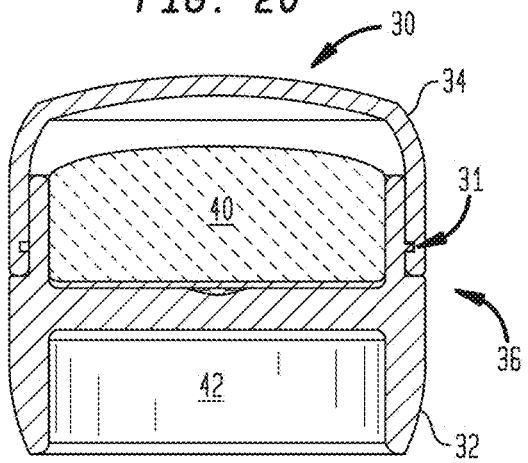
FIG. 20 is a sectional schematic of the thread conditioning dispenser of FIG. 19 taken along section line 20-20 of FIG. 19.
Figure 21:
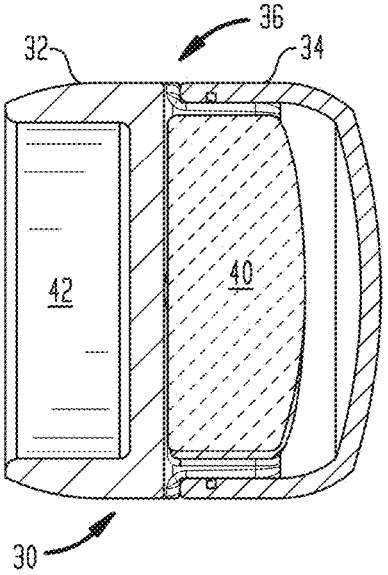
FIG. 21 is a sectional schematic of the thread conditioning dispenser of FIG. 19 taken along section line 21-21 of FIG. 19.
Figure 22:
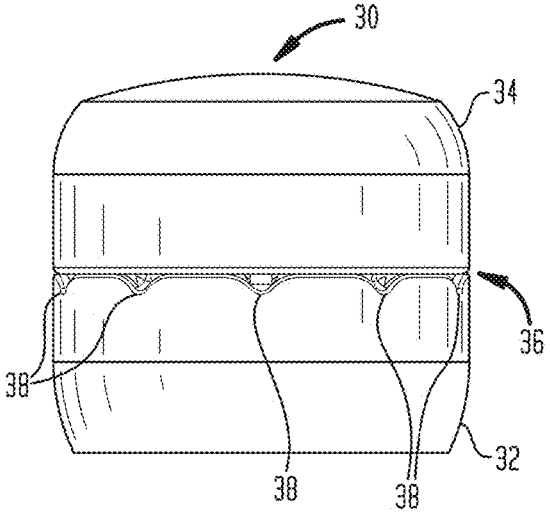
FIG. 22 is a front elevation of the thread conditioning dispenser of FIG. 19.

FIGS. 7 through 12 further illustrate the geometric configuration of cap 34 portion and conditioner storage and dispensing portion 32. Cap 34 comprises dome 33 and downwardly extending cylindrical sidewall 35 opening at outwardly flaring mouth 39. Annular notch 37 is formed in downwardly extending cylindrical sidewall 35 to engage lug 31 formed in upwardly extending resilient sidewall 44, lug 31 being best illustrated in FIG. 20.

Figure 18:
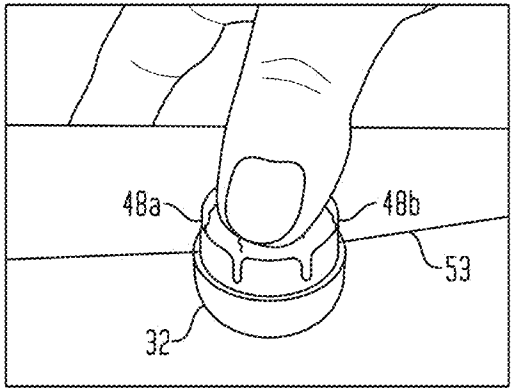
Figure 19:
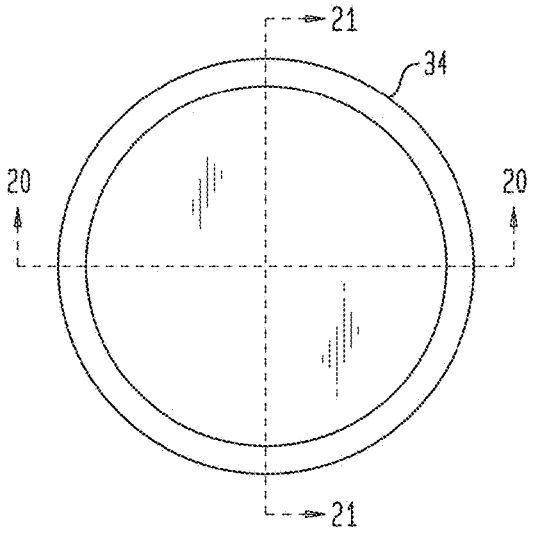
FIG. 19 is a top view of an alternative thread conditioning dispenser of the present invention.

FIGS. 13 through 18 illustrate how thread conditioning dispenser 30 can be used to treat thread 53 being wound onto bobbin 54 of sewing machine 56 wherein thread wound around supply spool 58 passes through thread guide 60 and around tensioning roller 62, through notches 48*a* and 48*b* and channel 50 of thread conditioner dispenser 30 and onto bobbin 54 prior to its use in an otherwise conventional machine sewing operation. Particular attention is directed to FIG. 18 illustrating how provision of notches 48 makes it possible for thread 53 to pass through conditioner 40 being directed through the mass of conditioner 40 by virtue of tension in thread 53 as it is drawn through. As mentioned hereinafter, thread 53 does not need to be pressed into conditioner 40; rather thumb pressure is applied to prevent "tunneling" as thread 53 picks up conditioner 40 on its passage therethrough. Tunneling is usually only an issue when long lengths of thread 53 are treated.

FIGS. 19 through 22 further illustrate the geometric configuration of cap 34 portion and conditioner storage and dispensing portion 32 of another thread conditioner dispenser of the present invention.

FIG. 23 is a skeletonized perspective view of a thread conditioner dispenser of the present invention illustrating how notches 38 communicate with each other through channels 50 so that thread may enter through one notch 38, pass through conditioner 40 and exit through a diametrically opposed notch 38. FIG. 24 is lower exterior perspective view of the thread dispenser of FIG. 19.

Figure 25:
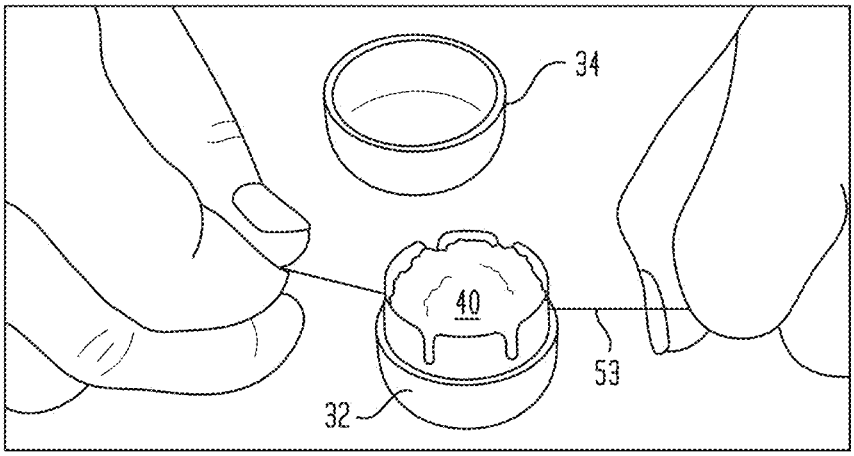
FIGS. 25-27 schematically illustrate use of the thread conditioning dispenser of the present invention to treat thread as it is being prepared for hand sewing.
Figure 26:
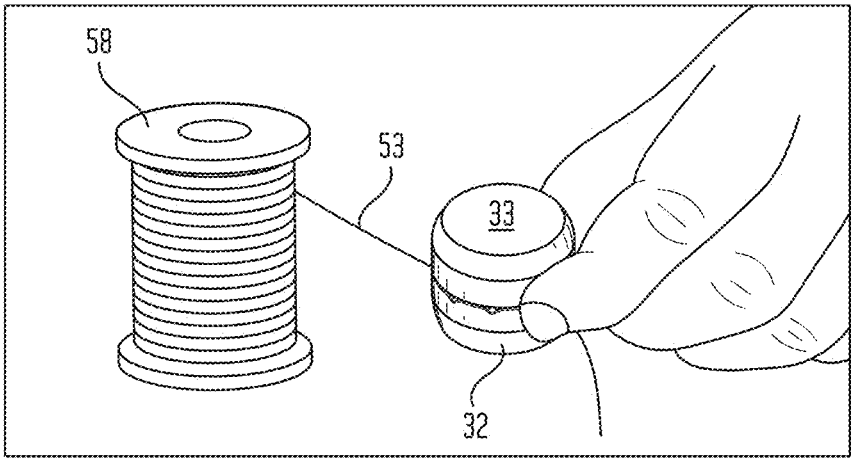
Figure 27:
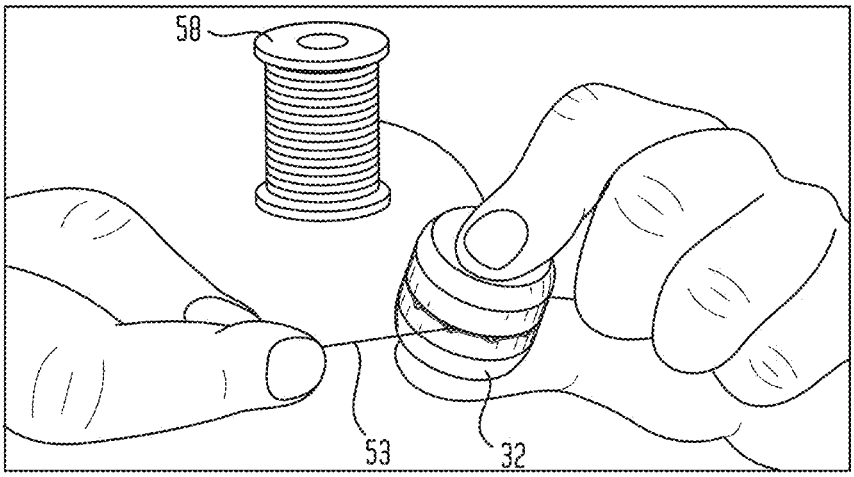

FIGS. 25-27 illustrate how thread 53 is manually coated with conditioner 40. It is important to note that provision of notches and channels makes it possible to pass thread through conditioner without manually pressing the thread into the conditioner when manually coating a length of thread. When a bobbin is being wound however, we have found that the thread forms a tunnel through the conditioner when a considerable length of thread has been pulled through thus making it prudent to press against the top of the conditioner mass as shown in FIG. 18 to collapse tunnels as they are being formed. Note however that the thumb does not need to contact the thread, it only needs to provide pressure against the mass of conditioner so that tunnels are not formed so as to allow the thread to avoid contact with conditioner.

Figure 28:
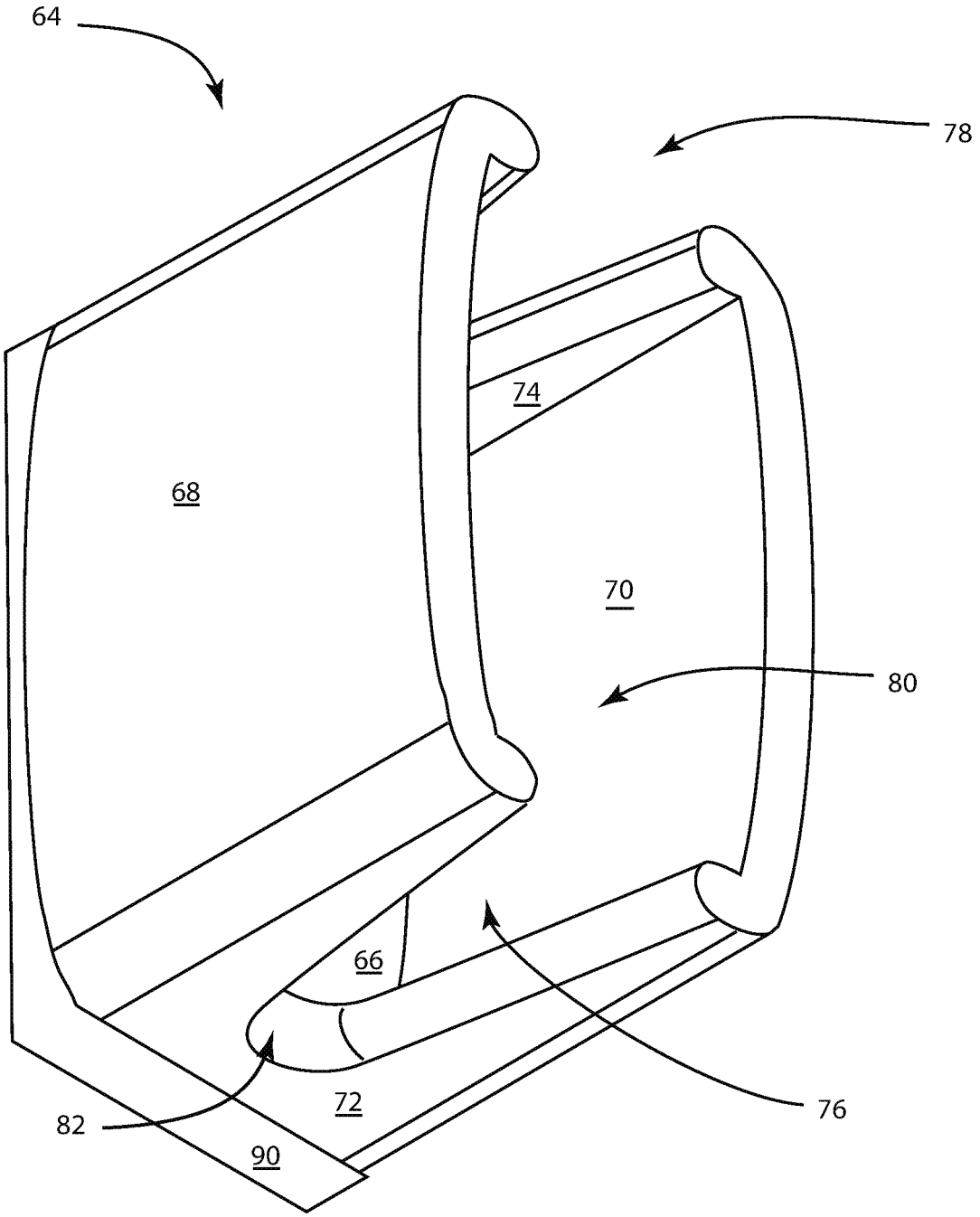
FIG. 28 is an isometric perspective of a thread conditioning dispenser of the present invention adapted to be mounted on a sewing machine viewed looking into the open end of the dispenser.
Figure 29:
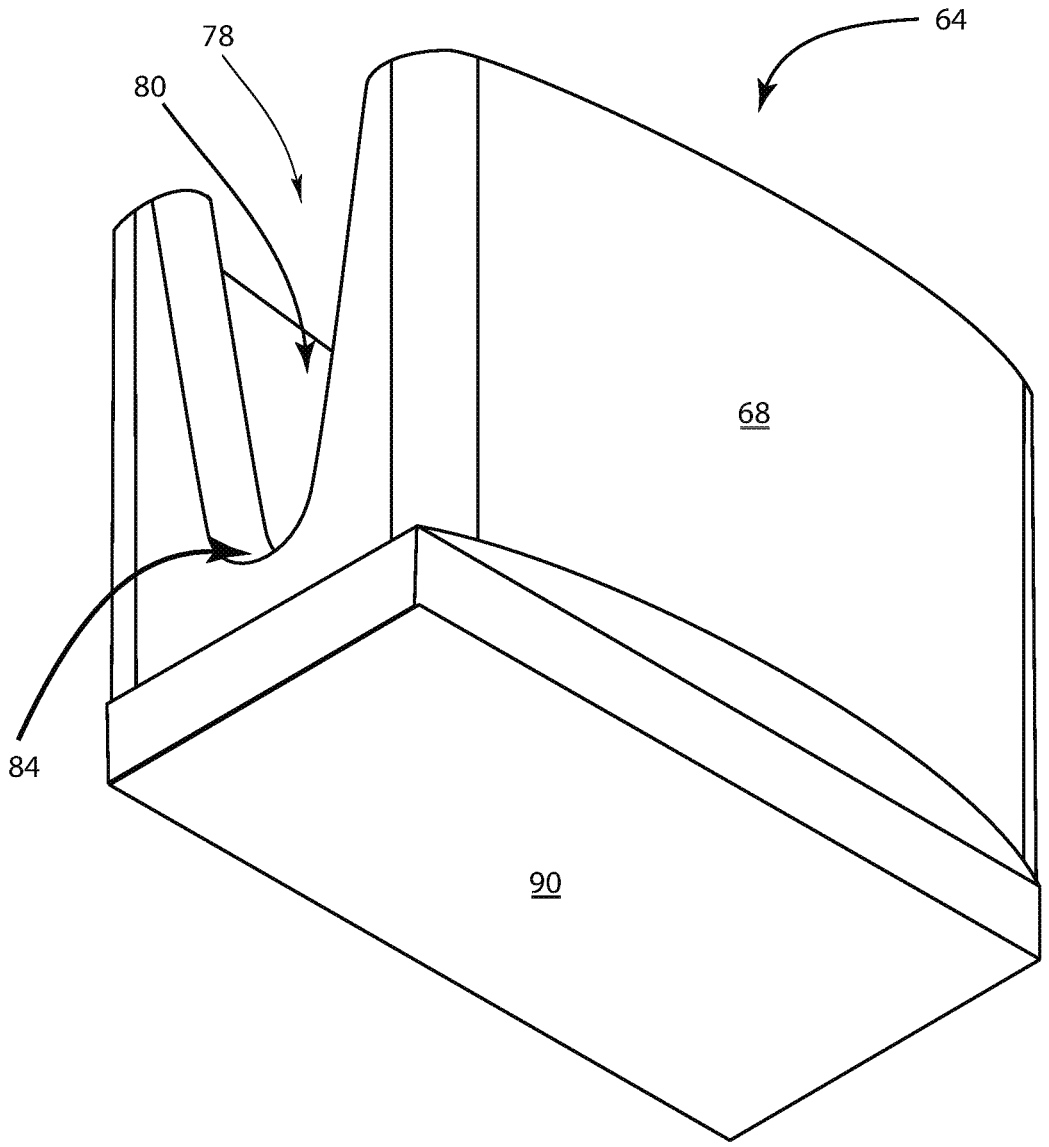
FIG. 29 is an isometric perspective of a thread conditioning dispenser of the present invention adapted to be mounted on a sewing machine viewed looking from below the dispenser.
Figure 30:
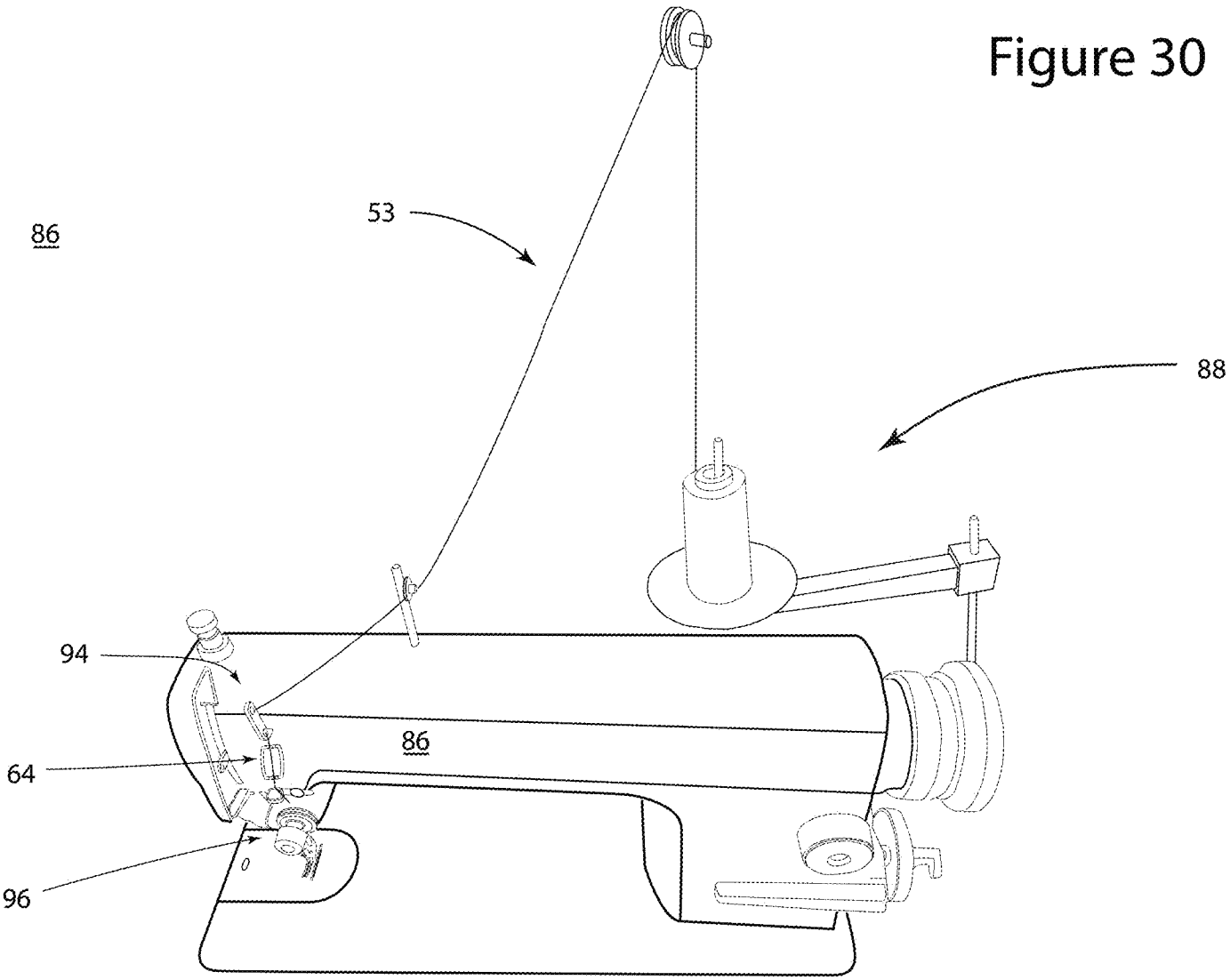
FIG. 30 is a schematic view illustrating the placement of a thread conditioning dispenser of the present invention on a conventional sewing machine.
Figure 31:
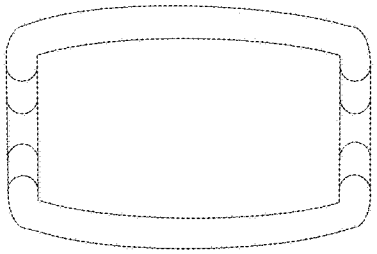
FIGS. 31-35 are top, left side, frontal, right side and bottom views, respectively, of a machine mountable thread conditioning dispenser of the present invention.
Figure 33:
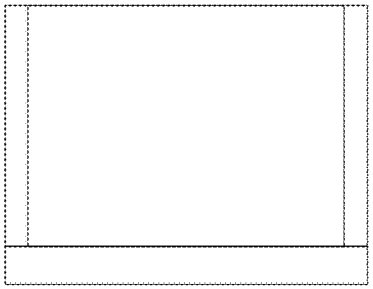
Figure 34:
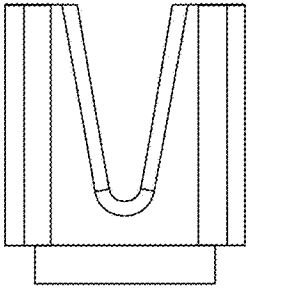
Figure 32:
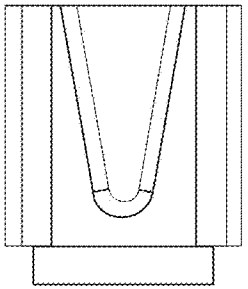
Figure 35:
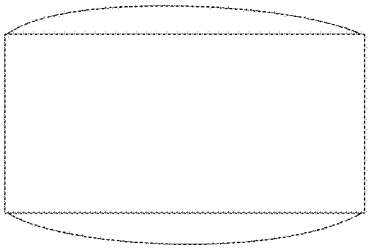
Figure 42:
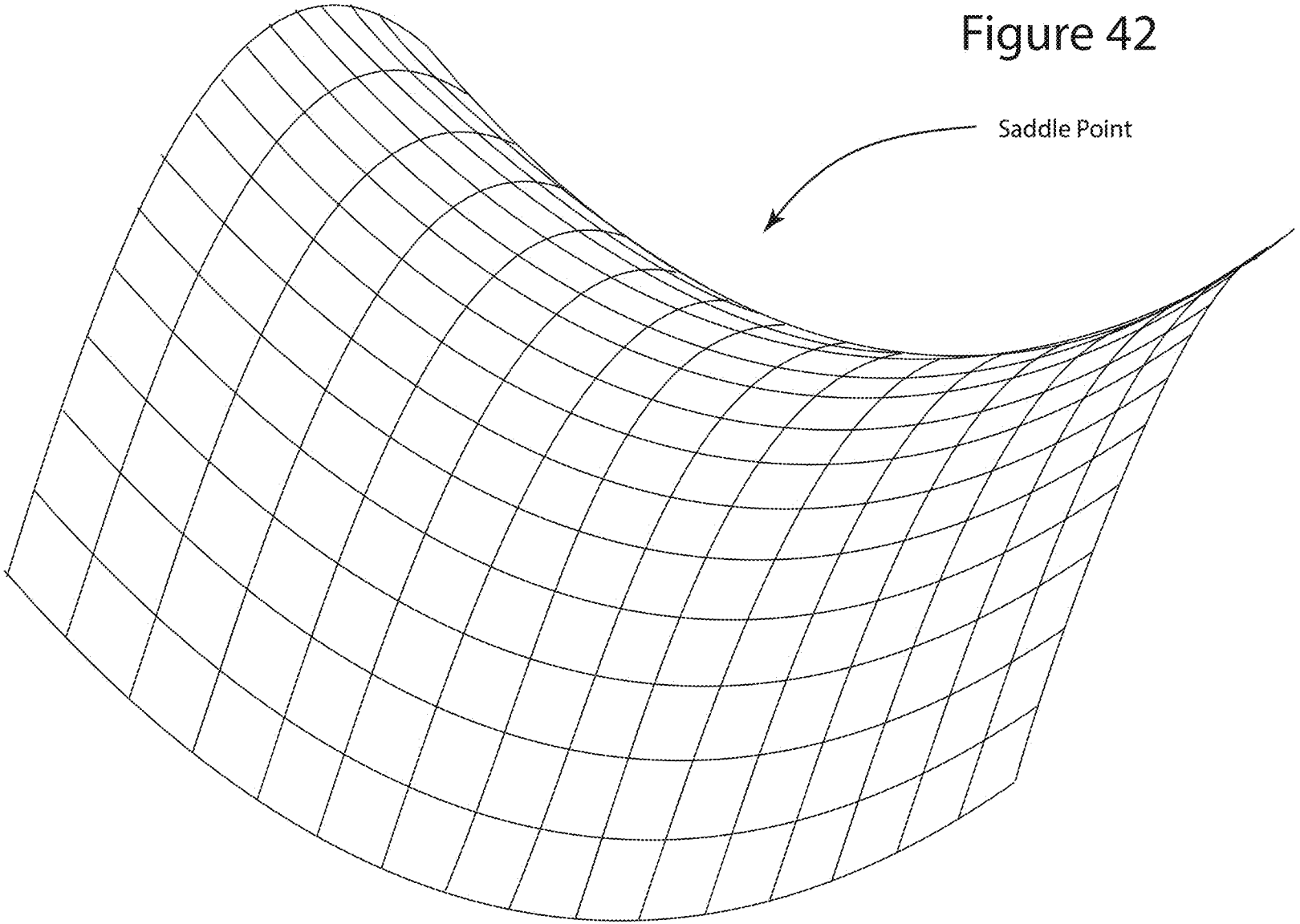
FIG. 42 illustrates a surface defining a saddle point.

Sewing machines use two threads to form their stitches, one from an upper thread supply and one from a bobbin. FIGS. 28, 29 and 31-35 illustrate dispenser 64 which is particularly well-suited for use with sewing machines having base 66 supporting opposed longitudinal sidewalls 68 and 70 joined by transverse sidewalls 72 and 74 having V-shaped notches 76 and 78 formed therein respectively. Thread conditioning composition (not shown here) is stored in cavity 80 defined between base 66 sidewalls 68, 70, 72 and 74. As illustrated in FIG. 28, cavity 80 is open to allow pressure to be manually applied to thread conditioning composition contained therein. V-shaped notches 76 and 78 have rounded bottoms defining saddle points 82 and 84 at their lowest extremities.

To aid in attachment to the face 86 of sewing machine 88, attachment layer 90 is provided below base 66 of dispenser 64. Attachment layer 90 may take the form of double stick tape (tape bearing adhesive on both sides), a layer of adhesive provided on a deformable foam layer or any suitable mechanical arrangement allowing dispenser 64 to be removably attached to face 86 of sewing machine 88. Desirably, the thickness of attachment layer 90 and the depths of V-shaped notches 76 and 78 are chosen such that when attached to a surface the lowermost extremity of each of V-shaped notches 76 and 78 is no more than about 6 millimeters, preferably no more than 4, more preferably no more than 3, still more preferably no more than 2 and most preferably no more than 1 millimeter from said surface. Ideally when in use and attached to face 86 of sewing machine 88 between reciprocating take up lever 94 and upper thread tension control 96, thread 53 will just clear the lowermost extremity of V-shaped notches 76 and 78.

In FIG. 41, thread 53*a* has a frayed end 98, while thread 53 having been treated with thread conditioning composition remains unfrayed and so can easily be passed through eye 100 of needle 102.

Throughout this specification and claims, when the term "cylindrical" is used, it is to be understood that this term is not limited to right circular cylinders but rather extends to all shapes having surfaces wherein the generators of said surface are all parallel to each other. Accordingly it can be appreciated that this term would extend to cylinders having an oval cross-section or any arbitrary cross-section so long as the generators of the surfaces defining such cross-section are parallel to each other. It should also be noted that a curvilinear cylinder is merely a degenerate form of a saddle point having an infinite radius of curvature in one of the orthogonal directions defining the saddle point.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A dispenser for thread conditioner compound comprising: a substantially planar base, two longitudinally extending sidewalls attached to said substantially planar base and being joined by two transverse sidewalls, a receptacle for thread conditioning compound being defined interior to said two longitudinally extending sidewalls, said substantially planar base and said two transverse sidewalls, each transverse sidewall having a single notch formed therein, the point on each said notch closest to said substantially planar base defining a lower surface with a saddle point wherein the radius of curvature of the generators of the lower surface with the saddle point as viewed normal to the side wall are curved upwardly but are curved downwardly when viewed in the direction lying within the surfaces of the sidewall and transverse to the opening of the notch through the sidewall, and an adhesive layer attached to said substantially planar base for removably attaching said dispenser for thread conditioner to a solid surface, wherein a join of each longitudinally extending sidewall and each transverse sidewall forms a rounded corner, wherein the dispenser further comprises a thread conditioner mass capable of transmitting pressure to a thread passing therethrough when pressure is applied to the surface of the thread conditioner mass, and wherein the dispenser provides access to manually apply pressure directly to the surface of the thread conditioner mass during use, and wherein the dispenser is attachable to a support surface and the lowermost extremity of each said notch is no more than about 6 millimeters from said support surface when so attached.

2. The dispenser for thread conditioner compound of claim 1, wherein the dispenser is attachable to a support surface and the lowermost extremity of each said notch is no more than about 3 millimeters from said support surface when so attached.

3. A method of manually conditioning thread utilizing the dispenser for thread conditioner compound of claim 1, comprising the steps of:

(i) providing a thread;

(ii) providing the dispenser for thread conditioner compound having a mass of thread conditioner disposed within the receptacle; and (iii) urging said thread into said mass of conditioner by disposing said thread adjacent said dispenser with a portion adjacent said one notch, another portion adjacent said other notch and exerting tension upon said thread urging it into said notches and into said mass of conditioner.

4. A method of conditioning thread to be placed upon a bobbin in a sewing machine utilizing the dispenser for thread conditioner compound of claim 1, comprising the steps of:

providing a bobbin, a supply spool having thread wrapped therearound, a sewing machine having a thread supply spindle, guide means for directing thread wrapped round said supply spool to said bobbin, and means for rotating said bobbin;

(ii) providing the dispenser for thread conditioner compound having a mass of thread conditioner disposed within the receptacle;

(iii) obtaining a free end of a length of thread from said supply spool, passing said thread through said guide means and securing it to said bobbin;

(iv) urging said thread into said mass of conditioner by disposing said thread adjacent said dispenser with a portion adjacent said one notch, another portion adjacent said other notch and exerting tension upon said thread urging it into said notches and into said mass of conditioner; and (v) drawing said thread through said mass of conditioner while applying pressure to said mass of conditioner to ameliorate tunneling occasioned by passage of said thread through said mass of conditioner.

5. The dispenser for thread conditioner compound of claim 1, wherein each notch comprises two legs joined by a radiused bottom portion and forming a shape approximating a "U" or "V" shape such that the notch is wider at an open end of the "U" or "V" shape than at the radiused bottom portion.

6. The dispenser for thread conditioner compound of claim 1, wherein the contents of the dispenser consists of the thread conditioner mass capable of transmitting pressure to a thread passing therethrough when pressure is applied directly to the surface of the thread conditioner mass.

7. A thread conditioner container comprising a substantially rectangular base having a sidewall rise from each edge thereof, each sidewall having a first end and a second end joined to the sidewall adjacent thereto, wherein two of the sidewalls each have a centrally located notch between the first end and the second end and the lowermost extremity of each of said notches defines a saddle point, such that a top elevation view of the sidewalls forms a substantially square bracket shape around a thread conditioner reservoir adapted to retain a thread conditioner mass;

and wherein the thread conditioner container is operative to accommodate a thread passing through the thread conditioner reservoir between the centrally located notches, wherein the dispenser is attached to a surface of a sewing machine and the lowermost extremity of each of said notches is no more than about 6 millimeters from said surface of the sewing machine when so attached.

8. The dispenser for thread conditioner compound of claim 7, wherein the dispenser is attached to said surface of said sewing machine and the lowermost extremity of each of said notches is no more than about 3 millimeters from said surface of the sewing machine when so attached.

9. The dispenser for thread conditioner compound of claim 7, wherein each notch comprises two legs joined by a radiused bottom portion and forming a shape approximating a "U" or "V" shape such that the notch is wider at an open end of the "U" or "V" shape than at the radiused bottom portion.

10. The dispenser for thread conditioner compound of claim 7, wherein the dispenser contains a thread conditioner mass capable of transmitting pressure to a thread passing therethrough when pressure is applied directly to the surface of the thread conditioner mass.

11. A dispenser for thread conditioner compound comprising: a substantially planar base, two longitudinally extending sidewalls attached to said substantially planar base and being joined by two transverse sidewalls, a receptacle for thread conditioning compound being defined interior to said two longitudinally extending sidewalls, said substantially planar base and said two transverse sidewalls, each transverse sidewall having a single notch formed therein, the point on each said notch closest to said substantially planar base defining a lower surface with a saddle point wherein the radius of curvature of the generators of the lower surface with the saddle point as viewed normal to the side wall are curved upwardly but are curved downwardly when viewed in the direction lying within the surfaces of the sidewall and transverse to the opening of the notch through the sidewall, wherein the receptacle portion of the dispenser contains a thread conditioner mass capable of transmitting pressure to a thread passing therethrough when pressure is applied to the surface of the thread conditioner mass, and wherein the dispenser provides access to manually apply pressure directly to the surface of the thread conditioner mass during use and wherein the dispenser is attachable to a support surface and the lowermost extremity of each said notch is no more than about 6 millimeters from said support surface when so attached.

12. The dispenser for thread conditioner compound of claim 11, wherein the dispenser is attachable to a support surface and the lowermost extremity of each said notch is no more than about 3 millimeters from said support surface when so attached.

13. A dispenser for thread conditioner compound according to claim 1, consisting of:

a substantially planar base, two longitudinally extending sidewalls attached to said substantially planar base and being joined by two transverse sidewalls, a receptacle for thread conditioning compound being defined interior to said two longitudinally extending sidewalls, said substantially planar base and said two transverse sidewalls, each transverse sidewall having a single notch formed therein, the point on each said notch closest to said substantially planar base defining a lower surface with a saddle point wherein the radius of curvature of the generators of the lower surface with the saddle point as viewed normal to the side wall are curved upwardly but are curved downwardly when viewed in the direction lying within the surfaces of the sidewall and transverse to the opening of the notch through the sidewall, and an adhesive layer attached to said substantially planar base for removably attaching said dispenser for thread conditioner to a solid surface, wherein a join of each longitudinally extending sidewall and each transverse sidewall forms a rounded corner, wherein the dispenser further comprises a thread conditioner mass capable of transmitting pressure to a thread passing therethrough when pressure is applied to the surface of the thread conditioner mass, and wherein the dispenser provides access to manually apply pressure directly to the surface of the thread conditioner mass during use, and wherein the dispenser is attachable to a support surface and the lowermost extremity of each said notch is no more than about 6 millimeters from said support surface when so attached.

14. A thread conditioner container according to claim 11, consisting of: a substantially planar base, two longitudinally extending sidewalls attached to said substantially planar base and being joined by two transverse sidewalls, a receptacle for thread conditioning compound being defined interior to said two longitudinally extending sidewalls, said substantially planar base and said two transverse sidewalls, each transverse sidewall having a single notch formed therein, the point on each said notch closest to said substantially planar base defining a lower surface with a saddle point wherein the radius of curvature of the generators of the lower surface with the saddle point as viewed normal to the side wall are curved upwardly but are curved downwardly when viewed in the direction lying within the surfaces of the sidewall and transverse to the opening of the notch through the sidewall, wherein the receptacle portion of the dispenser contains a thread conditioner mass capable of transmitting pressure to a thread passing therethrough when pressure is applied to the surface of the thread conditioner mass, and wherein the dispenser provides access to manually apply pressure directly to the surface of the thread conditioner mass during use and wherein the dispenser is attachable to a support surface and the lowermost extremity of each said notch is no more than about 6 millimeters from said support surface when so attached.

* * * * *